US005370742A

United States Patent [19]

Mitchell et al.

[11] Patent Number: 5,370,742

[45] Date of Patent: Dec. 6, 1994

[54] LIQUID/SUPERCRITICAL CLEANING WITH DECREASED POLYMER DAMAGE

[75] Inventors: James D. Mitchell, Alamo; Daniel T. Carty, Danville; James R. Latham, Livermore; Stephen B. Kong, Alameda; Robert J. Iliff, Oakley, all of Calif.

[73] Assignee: The Clorox Company, Oakland, Calif.

[21] Appl. No.: 912,933

[22] Filed: Jul. 13, 1992

[51] Int. Cl.[5] ..... D06L 1/00; B08B 7/04

[52] U.S. Cl. ..... 134/10; 134/21; 134/30; 8/142

[58] Field of Search ..... 134/10, 26, 30; 8/142

[56] References Cited

U.S. PATENT DOCUMENTS

| | | | |
|---|---|---|---|
| 3,969,196 | 7/1976 | Zosel | 203/49 |
| 4,012,194 | 3/1977 | Maffei | 8/142 |
| 4,219,333 | 8/1980 | Harris | 8/137 |
| 5,013,366 | 5/1991 | Jackson et al. | 134/1 |

FOREIGN PATENT DOCUMENTS

| | | |
|---|---|---|
| 0518653A1 | 12/1992 | European Pat. Off. . |
| 0530949A1 | 3/1993 | European Pat. Off. . |
| 2027003 | 6/1970 | Germany . |
| 3906735 | 6/1990 | Germany . |
| 3904513 | 8/1990 | Germany . |
| 3904514 | 8/1990 | Germany . |
| 4004111 | 8/1990 | Germany . |
| 3906724 | 9/1990 | Germany . |
| WO90/06189 | 6/1990 | WIPO . |

OTHER PUBLICATIONS

Poulakis et al., "Dyeing Polyester in Supercritical $CO_2$," *Chemiefasern/Textilindustrie,* vol. 41/93 (Feb. 1991), pp. 142–147.

Cygnarowicz et al., "Effect of Retrograde Solubility on the Design Optimization of Supercritical Extraction Processes," *I&EC Research,* vol. 28, No. 10 (1989), pp. 1497–1503.

Motyl, Keith M., "Cleaning Metal Substrates Using Liquid/Supercritical Fluid Carbo Dioxide," Report by Rockwell International for U.S. Department of Energy, RFP-4150 (Jan. 1988), pp. 1–29 (odd pages).

Hyatt, John A., "Liquid and Supercritical Carbon Dioxide as Organic Solvents," *J. Org. Chem.,* vol. 49, No. 26 (1984), pp. 5097–5100.

Brogle, Heidi, "$CO_2$ as a Solvent: Its Properties and Applications," *Chemistry and Industry,* (Jun. 19, 1982), pp. 385–390.

Motyl, Keith M., "Cleaning Metal Substrates Using Liquid/Supercritical Fluid Carbon Dioxide," NASA Tech Briefs MFS-29611 (undated).

"Supercritical Fluids," *Kirk-Othmer Encyclopedia of Chemical Technology,* 3d edition, (1978), Supplement Volume, pp. 875–893.

"Carbon Dioxide," *Kirk-Othmer Encyclopedia of Chemical Technology,* 3d edition (1978), vol. 4, pp. 725–742.

Francis, Alfred W., "Ternary Systems of Liquid Carbon Dioxide," vol. 58, (Dec. 1954), pp. 1099–1114.

*Primary Examiner*—José G. Dees
*Assistant Examiner*—Dwayne C. Jones
*Attorney, Agent, or Firm*—Majestic, Parsons, Siebert & Hsue

[57] ABSTRACT

The invention provides a cleaning method in which a solvent such as densified carbon dioxide can be used for rapid and efficient cleaning, but with decreased damage to solid components such as buttons. The method comprises contacting a substrate to be cleaned with a first fluid, removing the first fluid from contact with the substrate while replacing with a second fluid, and recovering the substrate substantially free of the first and second fluids and from the contaminant. The first fluid is a densified gas while the second fluid is a compressed gas. A preferred embodiment of the method includes the use of a pretreatment designed for compatibility with the densified first fluid.

15 Claims, 1 Drawing Sheet

LIQUID/SUPERCRITICAL CLEANING WITH DECREASED POLYMER DAMAGE

FIELD OF THE INVENTION

This invention generally relates to cleaning contaminants from textile substrates, and more particularly to a cleaning method using a solvent such as carbon dioxide in liquid or supercritical state that provides improved cleaning, decreased damage to components such as buttons, and decreased redeposition of contaminants.

BACKGROUND OF THE INVENTION

Cleaning contaminants from metal, machinery, precision parts, and textiles (dry cleaning) using hydrocarbon and halogenated solvents has been practiced for many years. Recently the environmental, health, and cost risks associated with this practice has become prohibitive. Carbon dioxide holds potential advantages among other non-polar solvents for this type of cleaning. It avoids many of the environmental, health, hazard, and cost problems associated with more common solvents.

Liquid/supercritical fluid carbon dioxide has been suggested as an alternative to halocarbon solvents in removing organic and inorganic contaminants from the surfaces of metal parts and in cleaning fabrics. For example, NASA Technical Brief MFA-29611 entitled "Cleaning With Supercritical $CO_2$" (March 1979) discusses removal of oil and carbon tetrachloride residues from metal. In addition, Maffei, U.S. Pat. No. 4,012,194, issued Mar. 15, 1977, describes a dry cleaning system in which chilled liquid carbon dioxide is used to extract soils adhered to garments.

Such methods suggested for cleaning fabrics with a dense gas such as carbon dioxide have tended to be restricted in usefulness because they have been based on standard extraction processes where "clean" dense gas is pumped into a chamber containing the substrate while "dirty" dense gas is drained. This dilution process severely restricts the cleaning efficiency, which is needed for quick processing and encourages soil redeposition.

Another problem with attempts to use carbon dioxide in cleaning is the fact that the solvent power of dense carbon dioxide is not high compared to ordinary liquid solvents. Thus, there have been attempts to overcome this solvent limitation.

German Patent Application 3904514, published Aug. 23, 1990, describes a process in which super-critical fluid or fluid mixture, which includes polar cleaning promoters and surfactants, may be practiced for the cleaning or washing of clothing and textiles.

PCT/US89/04674, published Jun. 14, 1990, describes a process for removing two or more contaminants by contacting the contaminated substrate with a dense phase gas where the phase is then shifted between the liquid state and the supercritical state by varying the temperature. The phase shifting is said to provide removal of a variety of contaminants without the necessity of utilizing different solvents.

However, the problems of relatively slow processing, limited solvent power, and redeposition have seriously hindered the usefulness of carbon dioxide cleaning methods.

Another particularly serious obstacle to commercial acceptability of dense gas cleaning is the fact that when certain solid materials, such as polyester buttons on fabrics or polymer parts, are removed from a dense gas treatment they are liable to shatter or to be severely misshapened. This problem of surface blistering and cracking for buttons or other solids has prevented the commercial utilization of carbon dioxide cleaning for consumer clothing and electronic and plastic parts.

SUMMARY OF THE INVENTION

Accordingly, it is an object of the present invention to provide a cleaning method in which an environmentally safe non-polar solvent, such as densified carbon dioxide, can be used for rapid and efficient cleaning, with decreased damage to solid components such as buttons and increased performance.

It is another object of the present invention to provide a cleaning method with reduced redeposition of contaminants, that is adaptable to the incorporation of active cleaning materials that are not necessarily soluble in the non-polar solvent.

In one aspect of the present invention, a method is provided for cleaning a substrate having a contaminant that comprises contacting the substrate with a first fluid, removing the first fluid from contact with the substrate while replacing with a second fluid, and recovering the substrate substantially free of the first and second fluids and from the contaminant. The first fluid is a densified gas in a liquid or in a supercritical state, while the second fluid is a compressed gas.

A particularly preferred first fluid is densified carbon dioxide with a pressure at a value of $P_1$, preferably above about 800 psi, and a temperature of $T_1$ preferably above about 20° C. A particularly preferred embodiment is compression of this gas to a value about equal to $P_1$ at about $T_1$ as the second fluid replaces the first fluid. Practice of the method improves cleaning efficiency, reduces redeposition of contaminants, and/or reduces damage to buttons and polymeric parts, such as other types of fasteners and decorative parts.

In another aspect of the present invention, carbon dioxide fluid is used to remove contaminants from substrates, such as fabrics, in conjunction with one or more of: a pathway between a variation of temperature, a variation of pressure, or a variation of temperature and pressure, a pathway being selected while separating the contaminant from the substrate; and, pretreating the substrate with cleaning agents that may have limited solubility in dense carbon dioxide, followed by contact with liquid or super critical carbon dioxide. A particularly preferred embodiment of the inventive method further includes the use of a hygroscopic material when any pretreatment, cleaning adjunct, substrate, or contaminant includes water.

Practice of the inventive cleaning method solves problems that have plagued prior attempts to use an environmentally safe solvent, such as carbon dioxide, and provides rapid and efficient cleaning.

DESCRIPTION OF THE PREFERRED EMBODIMENTS

Figure 1:
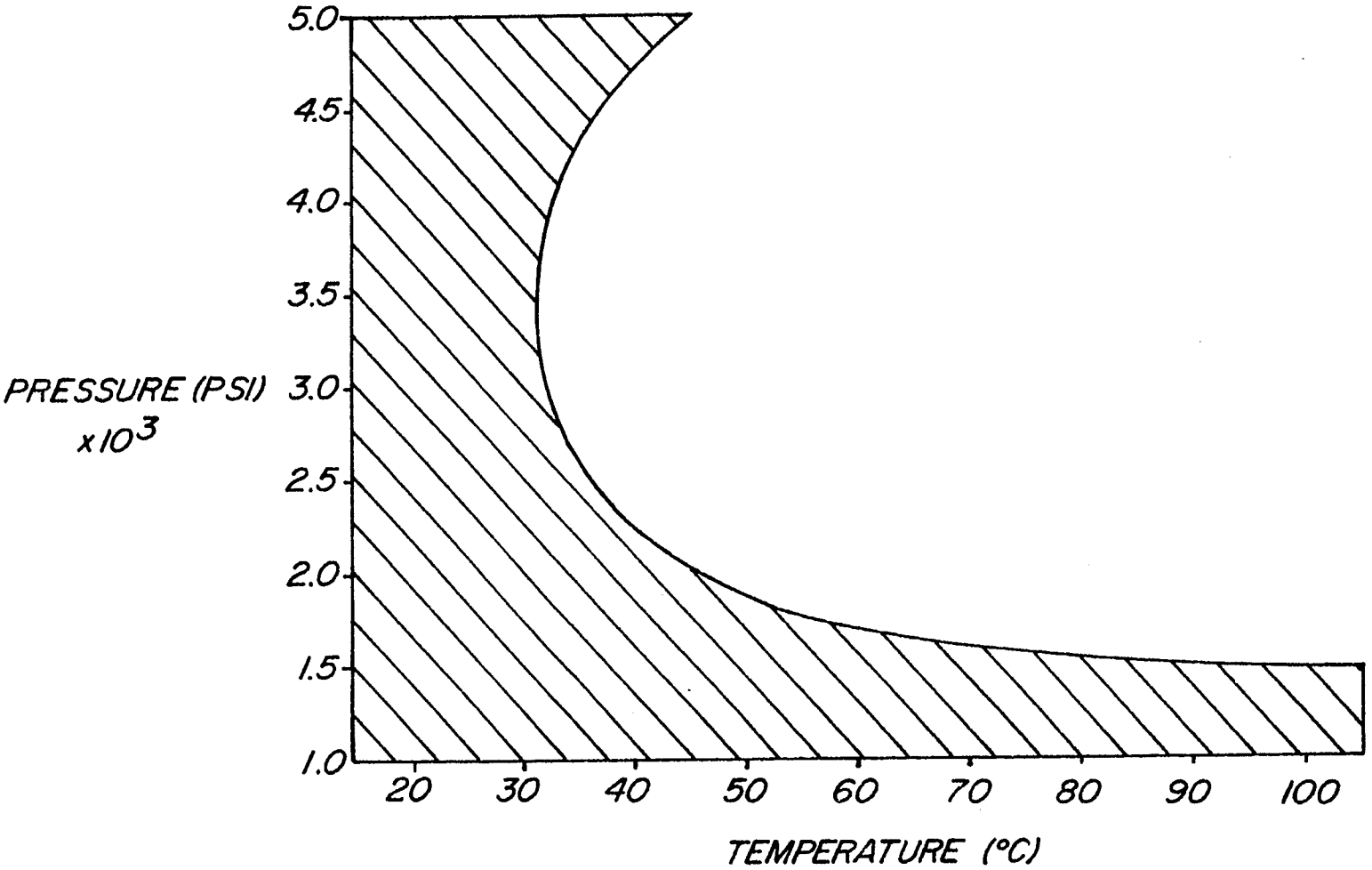
FIG. 1 graphically illustrates temperature and pressure conditions within a hatched area in which the inventive method is preferably practiced for reduced button damage.

Practice of the invention requires contact of a substrate having a contaminant with a first, substantially non-polar fluid. The contaminated substrate to be cleaned can take the form of soiled or stained fabrics or can be solid substrates, such as metal parts, with organic and inorganic contaminants. The first fluid with which the substrate to be cleaned is contacted is in a liquid or in a supercritical state.

With reference to FIG. 1 and use of carbon dioxide as the first fluid, a temperature range from slightly below about 20° C. to slightly above about 100° C. is indicated on the horizontal axis and a pressure range of from about 1000 psi to about 5000 psi on the vertical axis illustrates broadly the temperature and pressure ranges in which embodiments of the invention are preferably practiced. However, within this broad range of temperature and pressure, we have discovered there to be a zone (represented by the hatched area of the left, or on the convex side, of the curve) where surface blistering to components such as buttons can be reduced, whereas practice outside of the hatched region shown by FIG. 1 tends to lead to button damage that can be quite severe. As is seen by the hatched region of FIG. 1, preferred conditions are between about 900 psi to 2000 psi at temperatures between about 20° C. to about 45° C., with more preferred conditions being pressure from about 900 psi to about 1500 psi at temperatures between about 20° C. and 100° C. or from about 3500 psi to about 5000 psi at temperatures between about 20° C. and 37° C. Where fabrics are being cleaned, one preferably works within a temperature range between about 20° C. to about 100° C. In addition, it has been found within this range that processes which raise the temperature prior to decompression reduce the damage to polymeric parts.

Suitable compounds as the first fluid are either liquid or are in a supercritical state within the temperature and pressure hatched area illustrated by FIG. 1. The particularly preferred first fluid in practicing this invention is carbon dioxide due to its ready availability and environmental safety. The critical temperature of carbon dioxide is 31° C. and the dense (or compressed) gas phase above the critical temperature and near (or above) the critical pressure is often referred to as a "supercritical fluid." Other densified gases known for their supercritical properties, as well as carbon dioxide, may also be employed as the first fluid by themselves or in mixture. These gases include methane, ethane, propane, ammonium-butane, n-pentane, n-hexane, cyclohexane, n-heptane, ethylene, propylene, methanol, ethanol, isopropanol, benzene, toluene, p-xylene, chlorotrifluoromethane, trichlorofluoromethane, perfluoropropane, chlorodifluoromethane, sulfur hexafluoride, and nitrous oxide.

Although the first fluid itself is substantially nonpolar (e.g. $CO_2$), it may include other components, such as a source of hydrogen peroxide and an organic bleach activator therefor, as is described in copending patent application Ser. No. 754,809, filed Sep. 4, 1991, inventors Mitchell et al., of common assignment herewith. For example, the source of hydrogen peroxide can be selected from hydrogen peroxide or an inorganic peroxide and the organic bleach activator can be a carbonyl ester such as alkanoyloxybenzene. Further, the first fluid may include a cleaning adjunct such as another liquid (e.g., alkanes, alcohols, aldehydes, and the like, particularly mineral oil or petrolatum), as described in U.S. Pat. No. 5,279,615, inventors Mitchell et al., of common assignment herewith.

Contacting the substrate with the first fluid is preferably conducted in a dry cleaning apparatus as described in U.S. Pat. No. 5,267,455, inventors Dewees et al., incorporated herein in its entirety by reference and of common assignment herewith.

In a preferred mode of practicing the present invention, fabrics are initially pretreated before being contacted with the first fluid. Pretreatment may be performed at about ambient pressure and temperature, or at elevated temperature. For example, pretreatment can include contacting a fabric to be cleaned with one or more of water, a surfactant, an organic solvent, and other active cleaning materials such as enzymes. Surprisingly, if these pretreating components are added to the bulk solution of densified carbon dioxide (rather than as a pretreatment), the stain removal process can actually be impeded.

Since water is not very soluble in carbon dioxide, it can adhere to the substrate being cleaned in a dense carbon dioxide atmosphere, and impede the cleaning process. Thus, when a pretreating step includes water, then a step after the first fluid cleaning is preferable where the cleaning fluid is contacted with a hygroscopic fluid, such as glycerol, to eliminate water otherwise absorbed onto fabric.

Prior art cleaning with carbon dioxide has typically involved an extraction type of process where clean, dense gas is pumped into a chamber containing the substrate while "dirty" dense gas is drained. This type of continuous extraction restricts the ability to quickly process, and further when pressure in the cleaning chamber is released, then residual soil tends to be redeposited on the substrate and the chamber walls. This problem is avoided by practice of the inventive method (although the present invention can also be adapted for use as continuous extraction process, if desired).

The time during which articles being cleaned are exposed to the first fluid will vary, depending upon the nature of the substrate being cleaned, the degree of soiling, and so forth. However, when working with fabrics, a typical exposure time to the first fluid is between about 1 to 120 minutes, more preferably about 10 to 60 minutes.

In addition, the articles being cleaned may be agitated or tumbled in order to increase cleaning efficiency.

In accordance with the invention, the first fluid is replaced with a second fluid that is a compressed gas, such as compressed air or compressed nitrogen. By "compressed" is meant that the second fluid (gas) is in a condition at a lower density than the first fluid, however, the second fluid is at a pressure above atmospheric. The non-polar first fluid, such as carbon dioxide, is typically and preferably replaced with a nonpolar second fluid, such as nitrogen or air. Thus, the first fluid is removed from contact with the substrate and replaced with a second fluid, which is a compressed gas. This removal and replacement preferably is by using the second fluid to displace the first fluid, so that the second fluid is interposed between the substrate and the separate contaminant, which assists in retarding redeposition of the contaminant on the substrate. The second fluid thus can be viewed as a purge gas, and the preferred compressed nitrogen or compressed air is believed to diffuse more slowly than the densified first fluid, such as densified carbon dioxide. The slower diffusion rate is believed useful in avoiding or reducing damage to permeable polymeric materials (such as buttons) that otherwise tends to occur. However, the first fluid could be removed from contact with the substrate, such as by venting, and then the second fluid simply introduced. This alternative is a less preferred manner of practicing the invention.

Additionally, the second fluid preferably has a molar volume greater than that of the first fluid. This results in a second fluid less dense than the first fluid and has been found to facilitate removal of the first (denser) fluid because the second fluid is less miscible therein. Thus, the second fluid can be used to displace, or push out, the first fluid.

Most preferably, the second fluid is compressed to a value about equal to $P_1$ at a temperature $T_1$ as it replaces the first fluid. This pressure value of about $P_1/T_1$ is about equivalent to the pressure and temperature in the chamber as the contaminant separates from the substrate. That is, the value $P_1$ is preferably the final pressure of the first fluid as it is removed from contact with the substrate. Although the pressure is thus preferably held fairly constant, the molar volume can change significantly when the chamber that has been filled with first fluid is purged with the compressed second fluid.

The time the substrate being cleaned will vary according to various factors when contacting with the first fluid, and so also will the time for contacting with the second fluid vary. In general, when cleaning fabrics, a preferred contacting time will range from 1 to 120 minutes, more preferably from 10 to 60 minutes. Again, the articles being cleaned may be agitated or tumbled while they are in contact with the second fluid to increase efficiency. Preferred values of $P_1/T_1$ are about 800 to 5000 psi at 0° C. to 100° C., more preferably about 1000 to 2500 psi at 20° C. to 60° C.

Practice of the invention improves cleaning efficiency, reduces soil redeposition, as is illustrated by Example 1 below, reduces button damage, as illustrated by Example 2, and improves performance as is illustrated in Examples 3 and 4. Particularly preferred practice of this invention is generally as follows.

Stained and soiled garments are pretreated with a formula designed to work in conjunction with $CO_2$. This pretreatment may include a bleach and activator and/or the synergistic cleaning adjunct.

The garments are then placed into the cleaning chamber. As an alternate method, the pretreatment may be sprayed onto the garments after they are placed in the chamber, but prior to the addition of $CO_2$.

The chamber is filled with $CO_2$ and programmed through the appropriate pressure and temperature cleaning pathway. Other cleaning adjuncts can be added during this procedure to improve cleaning.

The $CO_2$ in the cleaning chamber is then placed into contact with a hygroscopic fluid to aid in the removal of water from the fabric.

The second fluid (compressed gas) is then pumped into the chamber at the same pressure and temperature as the first fluid. The second fluid replaces the first fluid in this step.

Once the first fluid has been flushed, the chamber can then be decompressed and the clean garments can be removed.

EXAMPLE 1

In the inventive process either liquid $CO_2$ or supercritical $CO_2$ was used as the first, substantially nonpolar fluid with which the substrate was contacted. The first fluid and a plurality of substrates were stirred at 642 rpm for 15 minutes, and then a second fluid (compressed gas) was used to remove the first fluid (with no stirring). The compressed gas used was nitrogen, which was compressed to a pressure and at a temperature equal to the first fluid treatment. The substrates treated in one or the other of the two inventive embodiments were three wool swatches for each embodiment. One wool swatch was stained with olive oil and a fat soluble red dye. A second wool swatch was stained with Crisco and a fat soluble red dye. A third swatch was a clean wool "tracer" to highlight problems with redeposition, if any.

Two comparison treatments were also performed that were analogous to the inventive process, except that no second fluid was utilized in either. A summary of these inventive and comparative cleaning conditions is as follows:

| First Fluid | Second Fluid |
|---|---|
| Invention (a) | |
| liquid $CO_2$ (1000 psi, 22° C., 101 $cm^3$/mole) | $N_2$ (1000 psi, 22° C., 354 $cm^3$/mole) |
| or | |
| supercritical $CO_2$ (2000 psi, 40° C., 57 $cm^3$/mole) | $N_2$ (2000 psi, 40° C., 194 $cm^3$/mole) |
| Comparison (a) | |
| liquid $CO_2$ (1000 psi, 22° C.) | None |
| or | |
| supercritical $CO_2$ (2000 psi, 40° C.) | None |

As noted, the molar volume of the second fluid used was substantially greater than the molar volume of the first fluid used. This means that the second fluid was less dense than the first fluid.

The inventive treated swatches showed a higher degree of cleaning and a decreased amount of redeposition onto the tracer swatches for both of the inventive embodiment treatments with respect to the comparison treatment.

EXAMPLE 2

In a second experiment, practice of the invention summarized as Invention (b) below was conducted with three different first fluid conditions. The substrates tested were white polyester, red polyester, and clear acrylic buttons, which showed a considerable potential for damage in earlier screenings. Thus, three inventive embodiments were utilized. The first inventive embodiment was where the first fluid contact was with liquid $CO_2$ at 1000 psi, 22° C. The second inventive embodiment was where the first fluid was supercritical $CO_2$ at 2000 psi, 40° C. The third inventive embodiment was where the first fluid was supercritical $CO_2$ at the beginning (1800 psi, 40° C.) that was shifted to liquid $CO_2$ by a temperature reduction to 20° C. The second fluid pressure and temperature conditions were about equivalent to those of the first fluid for these embodiments.

| First Fluid | Second Fluid |
|---|---|
| Invention (b) | |
| liquid $CO_2$ (1000 psi, 22° C.) | $N_2$ (1000 psi, 22° C.) |
| or | |
| supercritical $CO_2$ (2000 psi, 40° C.) | $N_2$ (2000 psi, 40° C.) |
| or | |
| supercritical $CO_2$ → liquid $CO_2$ (1800 psi, 40° C. → 20° C.) | $N_2$ (1800 psi, 20° C.) |
| Comparison (b) | |
| liquid $CO_2$ (1000 psi, 22° C.) | None |
| or | |
| supercritical $CO_2$ | None |

-continued

| First Fluid | Second Fluid |
|---|---|
| (2000 psi, 40° C.) or supercritical $CO_2$ → liquid $CO_2$ (1800 psi, 40° C. → 20° C.) | None |

When any of the three cleaning embodiments for the inventive process (b) were conducted, then no button damage occurred; however, in the comparative process (b), the buttons became opaque, had surface blisters, and cracked.

Accordingly, as illustrated by a comparison of the three inventive embodiments (b) and comparative process (b), identical first fluid treatments nevertheless resulted in severe button damage when the first fluid was not replaced with the compressed gas in accordance with the invention.

We have found in another aspect of the invention that the temperature and pressure conditions of the first fluid contact for optimal removal of contaminants differ, depending upon the nature of the contaminants. Thus, for example, soils that are primarily particulate are best removed under a different set of conditions (hereinafter, sometimes referred to as a "pathway") than those for oily soils. Thus, the sequence of temperature/pressure changes is surprisingly important to overall cleaning effectiveness. When contacting the substrate with the first fluid, the contacting includes determining (or initially having determined) a pathway between a variation of temperature, a variation of pressure, or a variation of temperature and pressure for separation of the contaminant from the substrate, and selecting the pathway determined for optimum results. This aspect of the invention is illustrated by Example 3.

EXAMPLE 3

Five different types of contaminating stains were tested. Clay was used as an all particulate stain. A mixture of particulate and oil was dirty motor oil. Another particulate and oil stain was sebum. Crisco hydrogenated vegetable oil and beef fat were used as all oil or fat stains. Preferred pathways for cleaning substrates bearing each type of stain are summarized by Table 1.

TABLE 1

| | Percent SR (E) | | | Visual Appearance | |
|---|---|---|---|---|---|
| Pathway | Clay | DMO | Sebum | vegetable oil | Beef fat |
| 1 | 10.5 | 29.8 | 37.8 | Clean | Clean |
| 2 | 10.9 | 22.7 | 30.5 | Very slight residue | Clean |
| 3 | 19.1 | 31.6 | 27.0 | Slight residue | Slight residue |
| 4 | 3.2 | 16.9 | 27.4 | Clean | Clean |

1 = 20° C., 900 psi → 60.C., 2500 psi → 20° C., 2500 psi
2 = 20° C., 900 psi → 20.C., 2500 psi → 60° C., 2500 psi
3 = 20° C., 900 psi → 20.C., 2500 psi → 60° C., 2500 psi → 60° C., 900 psi
4 = 20° C., 900 psi → 60 C., 900 psi → 60° C., 2500 psi → 20° C., 2500 psi As can be Been from the Table 1 data, cleaning performance on the particulate, clay soil, is impeded when temperature is increased before pressure (pathway 4). Likewise, cleaning performance on the dirty motor oil soil, which is oil but with considerable particulate matter, is also impaired when the temperature is increased before the pressure (pathway 4). Sebum soil, which is a mixture of oil/fat and particulate, has improved cleaning when temperature and pressure is changed simultaneously (pathway 1). An oily soil such as the Crisco hydrogenated vegetable oil is preferably removed by changing pressure and temperature together (pathway 1) or, unlike the situation with particulate soil, by changing pressure before temperature (pathways 2 and 3). Pure beef fat is removed under most of the above pathways, but less well where the pressure is raised before the temperature (pathways 2 and 3), unlike removal of particulate soils.

As earlier mentioned, pretreatment before contacting the first fluid is one preferred alternative for practicing this invention- Because pretreatments substrates and soils themselves will often include water, and since water is not very soluble in carbon dioxide, the water may adhere to the substrate being cleaned during the first and second fluid contacting steps. Accordingly, a preferred optional step in practicing the invention is to contact the cleaning fluid with a hygroscopic fluid, preferably after the stain or soil is removed but before the introduction of second fluid.

Example 4 illustrates cleaning with a pretreatment followed by use of a hygroscopic fluid after the carbon dioxide cycle.

EXAMPLE 4

A pretreatment formulation was prepared as follows:
methanol 5%
citric acid 5%
ethoxylated alcohol 2%
enzyme (Pepsin) 0.02%
water remainder Five grams of the pretreatment formulation was droppered onto stained and soiled wool swatches. The swatches were then immediately placed into the cleaning chamber, and cleaned in $CO_2$ at 2500 psi and 40° C. with agitation. The extraction was complete after 10 cubic feet of $CO_2$ had run through the chamber. Near the end of this process, 20 grams of glycerol were added to the chamber to aid in drying. A nitrogen purge was conducted at the end of the wash cycle at 2500 psi at 40° C. prior to decompression. Cleaning was determined by comparing reflectometer (% SRE) readings prior to and after the treatments.

It is to be understood that while the invention has been described above in conjunction with preferred specific embodiments, the description and examples are intended to illustrate and not limit the scope of the invention, which is defined by the scope of the appended claims.

What is claimed is:

1. A method for cleaning a substrate having a contaminate comprising:

contacting the substrate with a first fluid, the first fluid being a densified gas in a liquid or in a supercritical state, for a sufficient time to separate the contaminate from the substrate wherein the temperature of the fluid adjacent to the contaminate is at a value of from about 0° C. to about 100° C. as the contaminate separates;

removing the first fluid from contact with the substrate and replacing with a second fluid, the second fluid being nitrogen or air as a compressed gas, wherein the second fluid is used to displace the first fluid during the removing and the second fluid diffuses more slowly through permeable material in the chamber than does the first fluid and the second fluid has a temperature about equal to about 0° C. to about 100° C. as it replaces the first fluid and before recovering the substrate; and, recovering the substrate substantially free of contaminates.

2. The method as in claim 1 wherein the second fluid retards redeposition of the contaminate on the substrate.

3. The method as in claim I wherein the second fluid reduces damage to the substrate and other material in the chamber.

4. The method as in claim 1 wherein the pressure of fluid adjacent to the contaminate is at a from about 900 psi to about 5000 psi as the contaminate separates, and the second fluid has a pressure about equal to about 900 psi to about 5000 psi as it replaces the first fluid and before recovering the substrate.

5. The method as in claim 1 or 4 wherein the first fluid is substantially non-polar and includes carbon dioxide, methane, ethane, propane, ammonium-butane, n-pentane, n-hexane, cyclohexane, n-heptane, ethylene, propylene, methanol, ethanol, isopropanol, benzene, toluene, p-xylene, chlorotrifluoromethane, trichlorofluoromethane, perfluoropropane, chlorodifluoromethane, sulfur hexafluoride, or nitrous oxide.

6. The method as in claim 1 wherein the molar volume of the second fluid is greater than that of the first fluid.

7. The method as in claim 4 wherein the second fluid is non-polar.

8. The method as in claim 1 wherein the contacting includes determining pathways between a variation of temperature, a variation of pressure, or a variation of temperature and pressure while separating the contaminant from the substrate, and selecting one of the determined pathways.

9. The method as in claim 8 wherein the pathway selected includes elevating the temperature before reducing the pressure below about 900 psi to about 5000 psi to recover the substrate substantially free from damage.

10. The method as in claim 1 further comprising:

pretreating the substrate before contacting with the first fluid, the pretreating including contacting the substrate with one or more pretreatment agents selected from the group consisting of water, a surfactant, an organic solvent, a peroxide activator, and an enzyme.

11. The method as in claim 1 further comprising, when the pretreating includes water as a pretreatment agent, contacting the first fluid with sufficient amount of a hygroscopic material to remove water retained by the substrate after the pretreatment step.

12. The method as in claim 11 wherein the hygroscopic fluid is contacted with the first fluid before the second fluid replaces the first fluid.

13. The method as in claim 5 wherein the first fluid includes one or more cleaning agents and/or cleaning adjuncts.

14. The method as in claim 4 wherein the pressure is between 900 and 2000 psi at a temperature between 20° C. and 100° C.

15. The method as in claim 4 wherein the pressure is between 900 and 1500 psi at a temperature between 20° C. and 100° C. or 3500 to 5000 psi at 20° C. to 37° C. to reduce substrate damage.

* * * * *

UNITED STATES PATENT AND TRADEMARK OFFICE

CERTIFICATE OF CORRECTION

PATENT NO. : 5,370,742

DATED : December 6, 1994

INVENTOR(S) : Mitchell et al.

It is certified that error appears in the above-indentified patent and that said Letters Patent is hereby corrected as shown below:

In Column 9, line 10 in Claim 4:
replace "fluid adjacent to the contaminate is at a from about 900" with:

--fluid adjacent to the contaminate is at a value from about 900--

Signed and Sealed this

Sixteenth Day of May, 1995

Bruce Lehman

*Attest:*

BRUCE LEHMAN

*Attesting Officer*

*Commissioner of Patents and Trademarks*